United States Patent [19]

McCulloch

[11] 4,399,972

[45] Aug. 23, 1983

[54] PORTABLE SUPPORT PLATFORM

[76] Inventor: Roger L. McCulloch, 2023 Michigan Ave., La Porte, Ind. 46350

[21] Appl. No.: 253,274

[22] Filed: Apr. 13, 1981

[51] Int. Cl.[3] ..... B65D 19/34

[52] U.S. Cl. ..... 248/346; 52/802; 108/51.3

[58] Field of Search ..... 108/51.3, 51.1, 56.1, 108/56.3, 57.1; 52/802, 805; 206/386, 599, 600; 248/346

[56] References Cited

U.S. PATENT DOCUMENTS

| | | | |
|---|---|---|---|
| 2,576,715 | 11/1951 | Farrell | 108/51.3 |
| 2,840,430 | 6/1958 | Winer | 108/51.1 X |
| 2,996,276 | 8/1961 | Sorensen et al. | 108/51.3 |
| 3,676,279 | 7/1972 | Beaver | 52/805 X |
| 3,680,494 | 8/1972 | Giasi | 108/56.1 |
| 3,911,182 | 10/1975 | Lieberman | 108/56.1 X |
| 3,911,834 | 10/1975 | Quaintance | 108/57.1 X |
| 3,934,805 | 1/1976 | Elaschuk | 108/51.3 X |
| 4,220,100 | 9/1980 | Palmo et al. | 108/51.1 |
| 4,279,204 | 7/1981 | Propst | 108/51.1 X |

*Primary Examiner*—William E. Lyddane

*Attorney, Agent, or Firm*—Laubscher, Philpitt & Laubscher

[57] ABSTRACT

A portable support platform formed of lightweight material such as corrugated paperboard is disclosed. The platform is formed from a generally rectangular unitary blank having a rectangular top wall panel and opposed pairs of end wall panels and end flaps defined by first and second pairs of parallel fold lines, respectively. The blank further includes opposed pairs of side wall panels and side flaps defined by third and fourth pairs of parallel fold lines, respectively, the pairs of third and fourth fold lines being normal to the pairs of first and second fold lines. The end and side wall panels all have an equal width. Folding of the end and side flaps about the second and fourth fold lines, respectively, to corresponding positions on one side of the top wall panel normal to the end and side wall panels, respectively, and folding of the end and side wall panels about the first and third fold lines, respectively, to corresponding positions on the same side as, and normal to, the top wall panel result in the positioning of the side and end flaps opposite the top wall panel and in a common plane parallel with and spaced from the top wall panel, thereby defining a support platform having a partially enclosed chamber. In a preferred form, a honeycomb configured insert having a height equal to the width of the end and side wall panels is arranged completely within the platform chamber to further support the top wall panel.

4 Claims, 5 Drawing Figures

Fig. 1
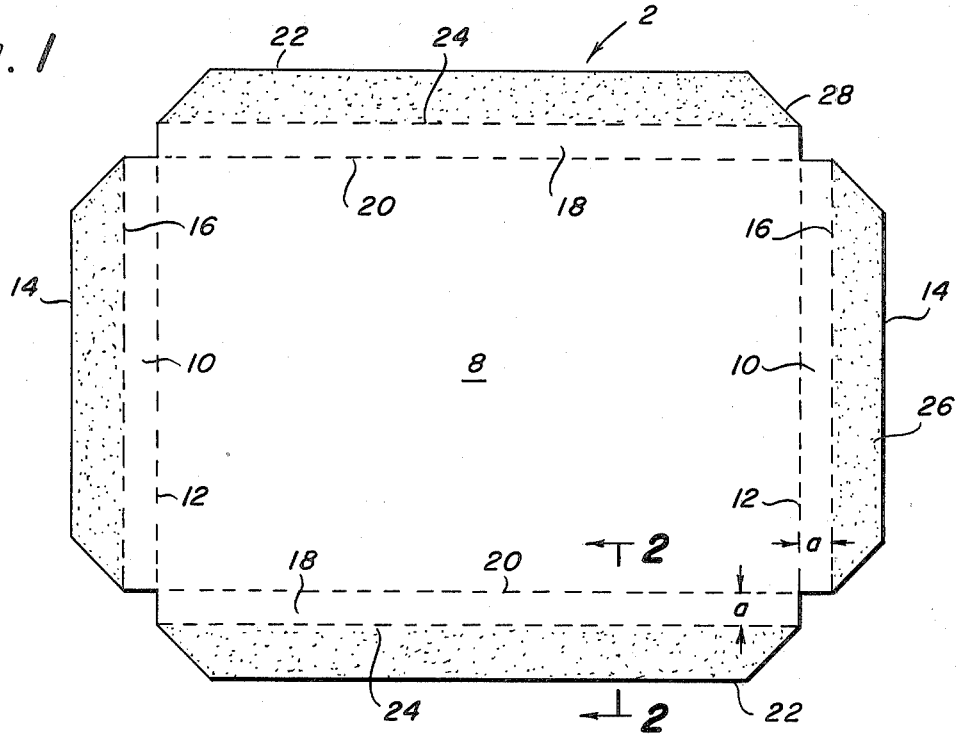
Fig. 2
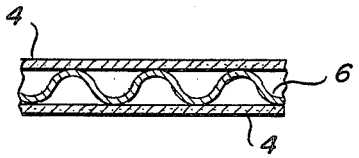
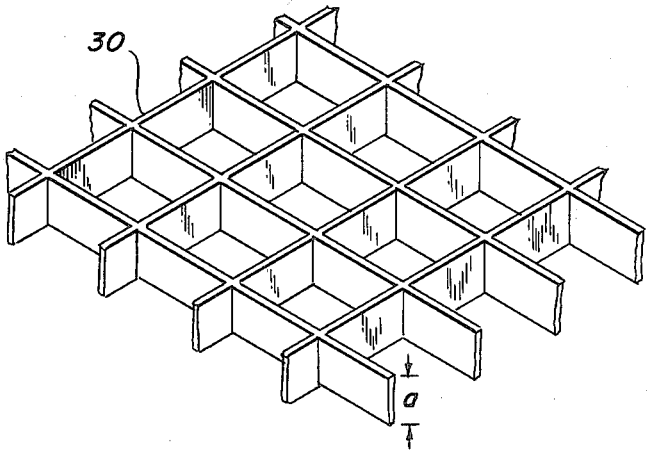
Fig. 3

PORTABLE SUPPORT PLATFORM

BACKGROUND OF THE INVENTION

The present invention relates to a portable support platform or construction base suitable for use with model train layouts, model race car tracks, doll houses, miniature villages, architectural models and the like. Through the use of corrugated paperboard elements or similar lightweight materials, a rigid, torsion-resisting planar structural unit is achieved having great strength and extremely light weight. A plurality of the structural units may be connected with one another to define a base of a desired size and configuration.

BRIEF DESCRIPTION OF THE PRIOR ART

Various construction modules and support platforms are well-known in the patented prior art. The U.S. Pat. Nos. to Glass et al. 3,352,054 and Schumacher 3,025,626, for example, disclose construction modules that may be assembled to define a base for model railroads and the like. The U.S. Pat. Nos. to Potter 1,947,168 and Brown 2,925,947 disclose support stands or bases having cellular reinforcements. Finally, building blocks and supports formed from sheets of paperboard or the like are disclosed in the U.S. Pat. Nos. to Kreider 2,131,349, Joseph 2,751,705, and Trenovan 3,581,431.

While the supports, modules, and blocks disclosed in the aforementioned patents normally operate quite satisfactorily, they each possess certain inherent drawbacks due to their relatively complex construction and limited versatility. These drawbacks are overcome by the subject invention wherein a support platform of great strength and versatility is formed from a lightweight, simple construction of reduced cost.

SUMMARY OF THE INVENTION

Accordingly, it is a primary object of the present invention to provide a generally rectangular unitary paperboard blank for forming a portable support platform. The blank includes a top wall panel, an opposed pair of end wall panels connected with opposite edges of the top wall panel by a pair of parallel first fold lines, respectively, the end wall panels having a given width, and a pair of end flaps connected with the pair of end wall panels by a pair of parallel second fold lines arranged parallel with the first fold lines. The blank further includes a pair of side wall panels connected with the remaining opposed edges of the top wall panel by a pair of parallel third fold lines, respectively, the third fold lines being arranged normal to the first fold lines, the side wall panels having the same width as the end wall panels, and a pair of side flaps connected with the pair of side wall panels by a pair of parallel fourth fold lines, respectively, the fourth fold lines being arranged parallel with the third fold lines. When the end and side flaps are folded about the second and fourth fold lines, respectively, to corresponding positions on one side of the top wall panel normal to the end and side wall panels, respectively, and when the end and side wall panels are folded about the first and third fold lines, respectively, to corresponding positions on the same side as, and normal to the top wall panel, the side and end flaps are positioned opposite the top wall panel and in a common plane parallel with and spaced from the top wall panel.

According to a further object of the invention, the blank in its folded condition defines a partially enclosed chamber adapted to receive an insert which further supports the top wall panel, thereby to define a support platform.

According to a more specific object of the invention, the insert has a honeycomb configuration and is expansible to completely fill the chamber, the height of the insert being generally equal to the width of the side and end walls.

It is a further object of the invention to provide a plurality of support platforms and means for connecting adjacent platforms to define an enlarged platform having a desired configuration.

BRIEF DESCRIPTION OF THE FIGURES

Other objects and advantages of the subject invention will become apparent from a study of the following specification when viewed in the light of the accompanying drawing, in which:

FIG. 1 is a plan view of a unitary blank from which the support platform is constructed;

FIG. 2 is a cross-sectional view of a portion of the blank taken along line 2—2 of FIG. 1;

FIG. 3 is a perspective view of one form of insert for the support platform;

DETAILED DESCRIPTION

Figure 4:
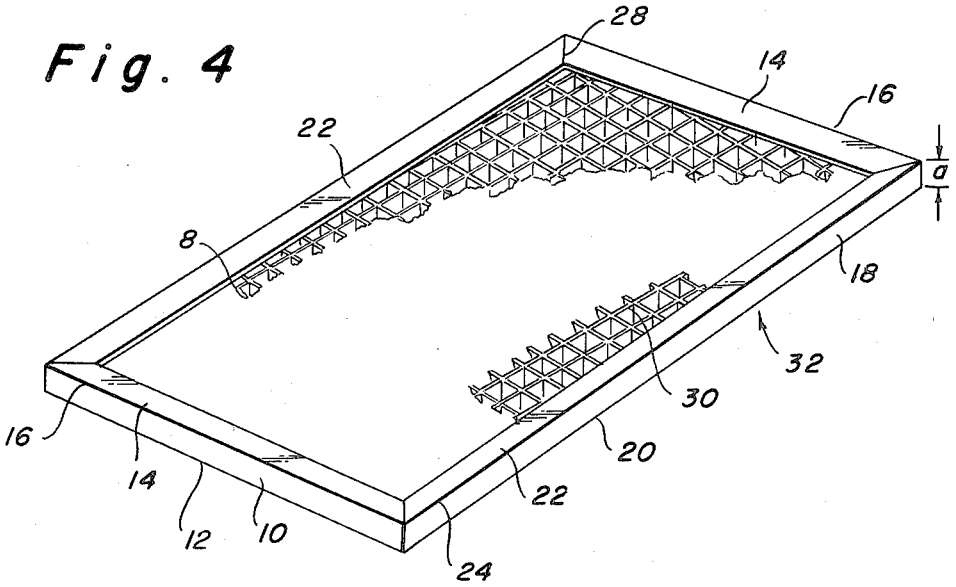
FIG. 4 is a bottom perspective view of the support platform including the insert of FIG. 3.

Referring first more particularly to FIG. 1, there is shown a generally rectangular unitary blank 2 formed of a suitable lightweight material such as paperboard. In its preferred form, the blank is formed of corrugated cardboard, a section of which is illustrated in FIG. 2. The corrugated cardboard comprises a pair of outer parallel facer sheets 4 and an undulating corrugated layer 6 connected with the outer sheets by any suitable means such as adhesive. The use of corrugated cardboard greatly enhances the strength of the resulting support platform.

The blank of FIG. 1 includes a top wall panel 8 and a pair of end wall panels 10 connected with opposite edges of the top wall panel by a pair of parallel first fold lines 12, respectively, the end wall panels each having a given width (a). A pair of end flaps 14 is connected with the pair of end wall panels by a pair of parallel second fold lines 16, respectively. The second fold lines are arranged parallel with the first fold lines.

The blank 2 further includes a pair of side wall panels 18 connected with the remaining opposed edges of the top wall panel by a pair of parallel third fold lines 20, respectively, the side wall panels each also having a width (a). The third fold lines are arranged normal to the first and second fold lines. A pair of side flaps 22 are connected with the side wall panels by a pair of parallel fourth fold lines being parallel with the third fold lines. The end flaps 14 and the side flaps 22 are coated with a layer of liquid adhesive 26 such as polyvinyl alcohol adhesive.

In order to form a support platform from the blank 2, the end and side flaps are folded about the second and fourth fold lines, respectively, to corresponding positions on one side of the top wall panel, respectively, and the end and side wall panels are folded about the first and third fold lines, respectively, to corresponding positions on the same side as, and normal to the top wall panel. Folding of the blank in this manner positions the side and end flaps opposite the top wall panel and in a common plane parallel with and spaced from the top wall panel, thereby defining a partially enclosed chamber. The order of folding the end and side wall panels and the end and side flaps about their respective fold lines is of no consequence so long as the end and side wall panels are arranged normal to one side of the top wall panel and the end and side flaps are arranged parallel with, opposite, and spaced from the same side of the top wall panel. The blank of FIG. 1, when folded as set forth above, defines a structurally sound support platform, the corner edges of the end flaps 14 and side flaps 22 being mitered as at 28.

The support platform constructed from the blank of FIG. 1 can be further strengthened by providing an insert or core with the partially enclosed chamber of the platform. FIG. 3. illustrates suitable core material for the insert 30. Like the blank 2 of FIG. 1, the insert is formed of any suitable material such as paperboard, particularly a high strength paperboard such as corrugated cardboard shown in FIG. 2. The insert is prefabricated by conventional means into any desired configuration, but preferably extends completely within the chamber to evenly support the top wall panel 8. In this regard, the insert has a height (a) generally equal to the width of the end and side walls panels. The insert 30 of FIG. 3 has a honeycomb configuration which is expansible to fit within chambers of varying dimension.

Assembly of the preferred embodiment of the support platform including the honeycomb insert as shown in FIG. 4 will now be described. One of the upper or lower edges of the expanded insert 30 is coated with a layer of liquid adhesive and applied against one side of the top wall panel 8, the expansion thereof being such that the end and side edges of the insert but the first fold lines 12 and the third fold lines 20, respectively, whereby the interstices of the insert expand and the insert covers the entire surface area of the top wall panel 8. The end wall panels 10 and side wall panels 18 of the blank are folded about the first and third fold lines 12, 20, respectively, to corresponding positions adjacent the inset and normal to the top wall panel. With the layer of liquid adhesive 26 applied to the inner surfaces of the end flaps 14 and the side flaps 32, respectively, the end flaps and the side flaps are folded about the second and fourth fold lines 16, 24 respectively, to corresponding positions normal to the end wall panels 10 and side wall panel 18, respectively, and in engagement with the uncoated edge of the insert. The insert is thus adhesively secured to both the top wall panel and to the end and side flaps of the blank. The insert is further contained within a channel which extends around the outer periphery of the platform defining the partially enclosed chamber. This arrangement increases the strength and rigidity of the support platform. The mitered corners 28 of the end and side flaps prevents overlapping of the flaps when they are folded as shown in FIG. 4, thereby enhancing the stability of the platform and insuring a planar support surface. Furthermore, the mitered corners impart a beamlike effect on the four edges of the resulting support platform to increase the strength and torsion-resistance thereof. Furthermore, owing to its lightweight construction, the platform is easily moved from one location to another when in either its assembled or disassembled condition.

Figure 5:
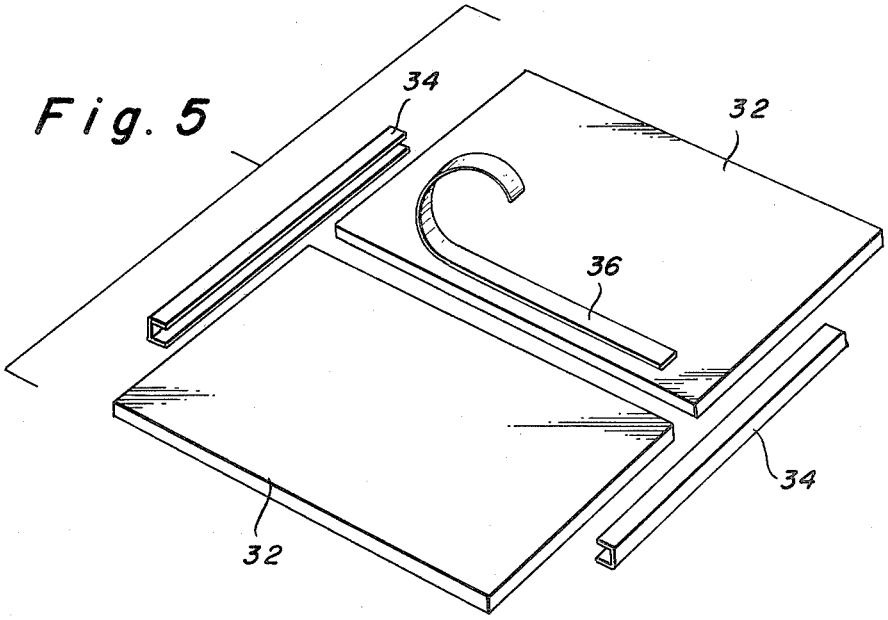
FIG. 5 is an exploded perspective view of a pair of support platforms adapted for connection with each other.

A plurality of support platform devices 32 may be connected together to define an enlarged platform of a desired size and configuration as shown in FIG 5. Channel shaped members 34 which may be formed of a synthetic plastic material such as polyethylene are adapted to receive and connect the edges of adjacent support platforms. A layer of adhesive tape 36 further serves to connect adjacent panels together.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. A support platform, comprising (a) a generally rectangular unitary paperboard blank, including (1) a rectangular top wall panel;

(2) a pair of end wall panels connected with opposite edges of said top wall panel by a pair of parallel first fold lines, respectively, said end walls having a given width;

(3) a pair of end flaps connected with said pair of end wall panels by a pair of parallel second fold lines, respectively, said second fold lines being arranged parallel with said first fold lines;

(4) a pair of side wall panels connected with the remaining opposed edges of said top wall panel by a pair of parallel third fold lines, respectively, said third fold lines being arranged normal to said first fold lines, said side wall panels having the same width as said end wall panels; and (5) a pair of side flaps connected with said pair of side wall panels by a pair of parallel fourth fold lines, respectively, said fourth fold lines being arranged parallel with said third fold lines, said end and side flaps being foldable about said second and fourth fold lines, respectively, to corresponding positions on one side of said top wall panel normal to said end and side wall panels, respectively, said end and side wall panels being foldable about said first and third fold lines, respectively, to corresponding positions on the same side as, and normal to said top wall panel, said side and end flaps being positioned opposite said top wall panel and in a common plane parallel with and spaced from said top wall panel, said blank in its folded condition defining a partially enclosed chamber;

(b) expansible insert means having a honeycomb configuration arranged within and completely filling said partially enclosed chamber for supporting said top wall panel, the height of said insert means being generally equal to the width of said side and end wall panels, respectively; and (c) means for connecting said insert means with said folded blank thereby to define the support platform.

2. Apparatus as defined in claim 1, wherein said end and side flaps are mitered.

3. Apparatus as defined in claim 2, wherein said blank and said insert means comprise corrugated cardboard.

4. Apparatus as defined in claim 3, and further comprising a plurality of said support platforms arranged in contiguous relation, and means for connecting adjacent ones of said support platform, thereby to define an enlarged platform having a desired configuration.

* * * * *

UNITED STATES PATENT AND TRADEMARK OFFICE

CERTIFICATE OF CORRECTION

PATENT NO. : 4,399,972

DATED : August 23, 1983

INVENTOR(S) : McCulloch, Roger L.

It is certified that error appears in the above—identified patent and that said Letters Patent is hereby corrected as shown below:

On the cover page, after the identification of the inventor, insert:

--[73] Assignee: Boise Cascade Corporation, Boise, Idaho --.

Signed and Sealed this

Seventeenth Day of April 1984

[SEAL]

Attest:

GERALD J. MOSSINGHOFF

Attesting Officer

Commissioner of Patents and Trademarks